US012429295B2

(12) United States Patent
Coscia

(10) Patent No.: US 12,429,295 B2
(45) Date of Patent: Sep. 30, 2025

(54) CONTROL DEVICE FOR CONTROLLING THE TEMPERATURE OF A PROCESS GAS AND HEAT EXCHANGER HAVING A CONTROL DEVICE

(71) Applicant: L'Air Liquide, Société Anonyme pour l'Etude et l'Exploitation des Procédés Georges Claude, Paris (FR)

(72) Inventor: Antonio Coscia, Hadamar (DE)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 150 days.

(21) Appl. No.: 18/387,670

(22) Filed: Nov. 7, 2023

(65) Prior Publication Data

US 2024/0159483 A1 May 16, 2024

(30) Foreign Application Priority Data

Nov. 10, 2022 (EP) ..... 22206671

(51) Int. Cl.
*F28F 27/02* (2006.01)

(52) U.S. Cl.
CPC ..... *F28F 27/02* (2013.01); *F28F 2250/06* (2013.01)

(58) Field of Classification Search
CPC ..... F22B 1/18; F28D 7/16; F28D 7/10; F28D 7/00; F28F 27/02; F28F 27/00; F28F 9/02; F28F 2250/06
See application file for complete search history.

(56) References Cited

U.S. PATENT DOCUMENTS 447,285 A * 3/1891 Alberger ..... F28B 1/02 251/228
1,918,966 A * 7/1933 Harkness ..... F22B 35/007 165/83
4,561,496 A * 12/1985 Kehrer ..... F28F 27/00 122/412

(Continued)

FOREIGN PATENT DOCUMENTS

CA 1 112 638 10/1979
DE 28 46 455 10/1979

(Continued)

OTHER PUBLICATIONS

European Search Report for corresponding EP 22206671, Mar. 17, 2023.

*Primary Examiner* — Travis Ruby
(74) *Attorney, Agent, or Firm* — Elwood L. Haynes

(57) ABSTRACT

The invention relates to a device for controlling the temperature of a process gas and a heat exchanger having such a control device. The control device has an outer housing with an inflow and outflow chamber. Cooled process gas can flow into the inflow chamber, while temperature-controlled process gas can flow out of the control device via the outflow chamber. An inner housing, which is fluidically connected to a hot gas line, extends from the inflow chamber through an element that mechanically separates the chambers into the outflow chamber. An axially movable piston, through which flow can take place, is arranged within the inner housing. The inner housing and the piston have openings which allow fluidic connections to the hot gas line, the inflow chamber and the outflow chamber.

14 Claims, 3 Drawing Sheets

(56) References Cited

U.S. PATENT DOCUMENTS

| | | | | |
|---|---|---|---|---|
| 4,993,367 | A * | 2/1991 | Kehrer | F28D 7/163 165/103 |
| 7,412,945 | B2 * | 8/2008 | Jekerle | F22B 35/001 165/101 |
| 12,158,109 | B2 * | 12/2024 | Oriol | F16K 17/046 |
| 2017/0051644 | A1 * | 2/2017 | Lagerlöf | F16K 3/26 |
| 2017/0108282 | A1 | 4/2017 | Müggenburg | |
| 2022/0228668 | A1 * | 7/2022 | Granottier | F28F 27/02 |

FOREIGN PATENT DOCUMENTS

| | | |
|---|---|---|
| DE | 10 2012 007721 | 10/2013 |
| EP | 0 356 648 | 3/1990 |
| EP | 0 617 230 B1 | 1/1998 |
| EP | 1 498 678 | 1/2005 |
| EP | 3 159 646 | 4/2017 |
| EP | 3 407 001 | 11/2018 |

* cited by examiner

CONTROL DEVICE FOR CONTROLLING THE TEMPERATURE OF A PROCESS GAS AND HEAT EXCHANGER HAVING A CONTROL DEVICE

CROSS REFERENCE TO RELATED APPLICATIONS

This application claims the benefit of priority under 35 U.S.C. § 119 (a) and (b) to European Patent Application No. 22206671.4, filed Nov. 10, 2022, the entire contents of which are incorporated herein by reference.

TECHNICAL FIELD OF THE INVENTION

The invention relates to a control device for controlling the temperature of a process gas, in particular for controlling the temperature of a process gas in a heat exchanger. The invention furthermore relates to a heat exchanger which comprises a control device according to the invention.

BACKGROUND

Heat exchangers for cooling hot process gases, for example those from petrochemical plants such as steam reformers, are well known from the prior art. Heat exchangers of this kind are often designed as shell-and-tube heat exchangers, which comprise a bundle of process gas-carrying and indirectly cooled heat exchanger tubes and a bypass tube, which is often arranged centrally and likewise carries process gas. In the heat exchanger tubes, the hot process gas is cooled by cooling medium conducted in a shell chamber of the heat exchanger. The process gas carried in the bypass tube is not cooled or is cooled only insignificantly since the bypass tube has a substantially larger diameter than the heat exchanger tubes. Alternatively, the bypass tube can also be routed outside the shell of the heat exchanger, with the result that there is no cooling at all of the portion of the process gas that flows through the bypass tube.

The cooling medium used, generally water, is converted into steam and can be used elsewhere as heating steam or process steam. Heat exchangers of this type are often referred to as waste heat boilers.

The temperature of the process gas at the outlet of the heat exchanger is controlled using the respective quantities of process gas which pass through the heat exchanger tubes and the bypass tube. Often, sole reliance is placed on control of the flow rate through the bypass tube, and in this case appropriate adjusting devices arranged within the bypass tube come into consideration as temperature control devices.

Another solution known from the prior art is disclosed by EP 0 617 230 B1. Here, the heat exchanger comprises at least two tube bundles, each of which is provided with a dedicated gas flow control device, the flow distribution and the flow rate between the different tube bundles being controlled in order to control the temperature of the process gas at the heat exchanger outlet.

The temperature control devices that are frequently used industrially and are based on flaps do not usually enable the maximum possible control range to be used, that is to say from no flow through the bypass to full flow through the bypass. This may be due to the fact that control with flaps generates a pressure drop that shifts the flow from the main cooling surface of the heat exchanger to the bypass (and vice versa). Here, the main cooling surface is defined by the heat exchanger tubes of the heat exchanger, which are cooled indirectly by the cooling medium.

Moreover, unwanted (leakage) flows often occur within the heat exchanger itself if the corresponding temperature control device does not completely seal. This is particularly the case with flap-based systems.

In known industrially applied solutions, complete closure of the bypass tube (no flow through the bypass tube) is therefore not readily possible. As a result of this limitation of the control range, the main cooling surface must be designed to be larger than actually required in order to compensate for this ever-present flow of hot process gas through the bypass tube.

Complete opening of the bypass tube with simultaneous interruption of the flow coming from the main cooling surface is also not readily possible in known industrially applied solutions. This limitation can restrict the total capacity of the system for operation at low utilization since the required minimum outlet temperature of the process gas from the heat exchanger can only be achieved above a certain (relatively high) system load.

In view of a possible failure of the temperature control device and its actuating drive, which can lead to unwanted full opening of the bypass tube, the maximum opening rate of the same needs to be mechanically limited for the most unfavourable critical design case. This design case is typically defined by the fact that the plant in question is being operated under full load and, in particular, the heat exchanger tubes have a maximum degree of contamination on the inside. The heat transfer to the process gas is correspondingly significantly worse than in the case of uncontaminated heat exchanger tubes, and the temperature of the cooled process gas is correspondingly higher.

A temperature control device which, in the event of a malfunction, closes in a spring-assisted manner, for example, and thus lowers the flow through the bypass tube to zero, is not desirable since uncontrolled closing of the bypass can lower the outlet temperature of the process gas (a mixture of uncooled and cooled process gas) to below a defined minimum temperature which is required for safe operation of downstream plant components.

EP 1 498 678 discloses a heat exchanger having a bypass tube which is leaktightly connected to a guide tube, wherein a piston designed as a closure element is arranged in an axially movable manner in the guide tube. The piston is of double-walled design, and cooling channels through which a coolant flows are provided in the double wall of the piston.

DE 10 2012 007 721 A1 discloses a process gas cooler having lever-controlled process gas cooler flaps. In this case, a flap shaft is provided which is connected to a drive body by means of levers and connecting rods in such a way that the gas throughput speed and quantity of the process gas can be controlled from the outside by means of the process gas cooler flaps with the aid of the drive body.

EP 3 159 646 A1 discloses a heat exchanger having a control device which comprises a throttle valve connected to a drive for setting a gas outlet temperature of the heat exchanger to a specific temperature range. In this case, an outlet speed and an outlet quantity of the uncooled exhaust gas flow from the bypass tube can be controlled by a throttle valve which is arranged at the outlet end of a bypass tube and can be adjusted by means of the drive of the control device, the throttle valve being manufactured in a temperature range which is prone to high-temperature corrosion from a material which is resistant to high-temperature corrosion.

SUMMARY

It is an object of the present invention to at least partially overcome the disadvantages of the prior art.

In particular, it is an object of the present invention to provide a control device for controlling the temperature of a process gas which allows the largest possible control range in respect of the process gas temperature to be set.

In particular, it is an object of the present invention to provide a control device for controlling the temperature of a process gas which includes control of the entire temperature range from maximally cooled process gas to uncooled process gas.

It is a further object of the present invention to provide a control device for controlling the temperature of a process gas which minimizes the occurrence of leakage flows in respect of the process gas flow.

It is a further object of the present invention to provide a control device for controlling the temperature of a process gas which, in the event of a technical failure of the control device, does not lead to a state in which a maximum permissible outlet temperature of the process gas can be exceeded.

It is a further object of the present invention to provide a heat exchanger which has a control device for controlling the temperature of a process gas and at least partially achieves at least one of the abovementioned objects.

The independent claims make a contribution to the at least partial achievement of at least one of the above objects. The dependent claims provide preferred embodiments which contribute to the at least partial achievement of at least one of the objects. Preferred embodiments of constituents of one category according to the invention are, where relevant, likewise preferred for identically named or corresponding constituents of a respective other category according to the invention.

The terms "having", "comprising" or "containing" etc. do not preclude the possible presence of further elements, ingredients etc. The indefinite article "a" does not preclude the possible presence of a plurality.

In accordance with one aspect of the present invention, a control device for controlling the temperature of a process gas is proposed, having an outer housing;

an inflow chamber, arranged within the outer housing, for cooled process gas, wherein the inflow chamber is fluidically connected to at least one cold gas line for carrying the cooled process gas;

an outflow chamber, arranged within the outer housing, for temperature-controlled process gas;

an outlet nozzle, which extends through the outer housing in the region of the outflow chamber, wherein the outlet nozzle is configured to discharge the temperature-controlled process gas from the outer housing;

a mechanical separating element, which spatially separates the inflow chamber and the outflow chamber from one another;

an inner housing having an interior, wherein the interior is fluidically connected to at least one hot gas line for carrying hot process gas, wherein the inner housing extends within the inflow chamber and through the mechanical separating element into the outflow chamber, wherein the inner housing comprises a first housing inlet opening, which is arranged in such a way that the hot process gas can flow into the interior of the inner housing, and wherein the inner housing comprises a second housing inlet opening, which is arranged in such a way that cooled process gas can flow into the interior of the inner housing, and wherein the inner housing comprises a housing outlet opening, which is arranged in such a way that temperature-controlled process gas can flow out of the interior of the inner housing into the outflow chamber;

a piston, through which flow can take place, which is designed as a hollow body and which has a piston interior, wherein the piston can be moved in the axial direction within the inner housing by means of an actuating drive, wherein the piston comprises a first piston inlet opening, which is arranged in such a way that hot process gas can flow into the piston interior, and wherein the piston comprises a second piston inlet opening, which is arranged in such a way that cooled process gas can flow into the piston interior, and wherein the piston comprises a piston outlet opening, which is arranged in such a way that temperature-controlled process gas can flow out of the piston interior into the interior of the inner housing, wherein the second housing inlet opening of the inner housing and the second piston inlet opening are arranged in such a way relative to one another that a free-flow cross-sectional area of the second piston inlet opening can be changed by the movement of the piston in the axial direction, thereby making it possible to control a quantity of cooled process gas which can flow into the piston interior via the second housing inlet opening of the inner housing and via the second piston inlet opening.

The control device according to the invention has an inner housing, which extends from an inflow chamber of the control device through a mechanical separating element into an outflow chamber, as well as a piston, which is designed as a hollow body, is arranged within the inner housing and can be moved in the axial direction within the inner housing. The inner housing has openings via which hot process gas can flow into the inner housing via the first housing inlet opening and cooled process gas can flow into the inner housing via the second housing inlet opening. Furthermore, the inner housing has at least one further opening, in this case a housing outlet opening, via which temperature-controlled process gas can flow out of the interior of the inner housing into the outflow chamber.

The piston, which is designed as a hollow body and through which flow can take place, has corresponding openings. Hot process gas can flow into the piston interior via a first piston inlet opening, in particular after it has passed through the first housing inlet opening of the inner housing, via the first piston inlet opening. In a corresponding manner, cooled process gas can flow into the piston interior via the second piston inlet opening, in particular after it has passed through the second housing inlet opening of the inner housing. In the piston interior, mixing of the hot process gas and the cooled process gas takes place. By means of this mixing, the temperature-controlled process gas can be obtained. This can then first pass through the piston outlet opening, can thereby flow into the interior of the inner housing, and can then pass, in particular, through the housing outlet opening of the inner housing. As a result, the temperature-controlled process gas can then flow out into the outflow chamber since the inner housing extends through the mechanical separating element into the outflow chamber, and the housing outlet opening is arranged in such a way that temperature-controlled process gas can flow out of the interior of the inner housing into the outflow chamber. The temperature-controlled process gas can then flow out of the control device via the outlet nozzle.

The inner housing comprises a first housing inlet opening, which is arranged in such a way that hot process gas can flow into the interior of the inner housing, in particular can flow into the interior of the inner housing from the at least one hot gas line.

The inner housing comprises a second housing inlet opening, which is arranged in such a way that cooled process gas can flow into the interior of the inner housing, in particular can flow into the interior of the inner housing from the inflow chamber.

The interior of the inner housing is fluidically connected to at least one hot gas line for carrying hot process gas, in particular is fluidically connected to the at least one hot gas line via the first housing inlet opening. In addition, the interior of the inner housing is fluidically connected to the inflow chamber, in particular is fluidically connected to the inflow chamber via the second housing inlet opening. In addition, the interior of the inner housing is fluidically connected to the outflow chamber, in particular is fluidically connected to the outflow chamber via the housing outlet opening.

The piston comprises a first piston inlet opening, which is arranged in such a way that hot process gas can flow into the piston interior, in particular can flow into the piston interior from the interior of the inner housing.

The piston comprises a second piston inlet opening, which is arranged in such a way that cooled process gas can flow into the piston interior, in particular can flow into the piston interior from the inflow chamber.

The piston comprises a piston outlet opening, which is arranged in such a way that temperature-controlled process gas can flow out of the piston interior, in particular can flow out of the piston interior into the interior of the inner housing.

According to one embodiment, the housing outlet opening of the inner housing is arranged adjacent to the outlet chamber. According to one embodiment, the first housing inlet opening of the inner housing is arranged adjacent to the hot gas line. According to one embodiment, the second housing inlet opening of the inner housing is arranged adjacent to the inflow chamber.

The piston can be moved in the axial direction within the inner housing. It is thereby possible to change the free-flow cross-sectional area defined by the second piston inlet opening. This is the case since the second housing inlet opening and the second piston inlet opening are arranged in such a way relative to one another that the free-flow cross-sectional area of the second piston inlet opening can be enlarged or reduced by the axial movement of the piston within the interior of the inner housing, or in the extreme case can be closed.

The wall of the inner housing and the second housing inlet opening arranged within the wall of the inner housing enable the free-flow cross-sectional area of the second piston inlet opening to be varied, i.e. changed, by moving the piston in the axial direction. Accordingly, a large or small amount or no cooled process gas flows into the piston interior, depending on the degree of opening of the second piston inlet opening and the free-flow cross-sectional area defined thereby. Corresponding temperature control of the process gas is thereby achieved.

According to one embodiment, the outside of the lateral wall of the piston is in surface contact with the inside of the lateral wall of the inner housing. Corresponding seals can be provided in order to minimize leakage flows between the piston and the inner housing. In principle, the configuration of the control device with a piston and the defined openings offers the advantage that leakage flows can be largely or completely avoided, which is not the case, for example, with devices based on flap systems.

The piston can be moved in the axial direction by means of an actuating drive. In other words, the piston can be moved along its physical or imaginary longitudinal axis.

According to one embodiment, the first housing inlet opening of the inner housing is arranged in the region of an end wall of the inner housing, in particular a first end wall of the inner housing.

According to one embodiment, the second housing inlet opening is arranged in the region of a lateral wall of the inner housing.

According to one embodiment, the housing outlet opening is arranged in the region of a further end wall of the inner housing, in particular in the region of a second end wall of the inner housing.

According to one embodiment, the first end wall of the inner housing adjoins the hot gas line. According to one embodiment, the second end wall of the inner housing adjoins the outlet chamber. According to one embodiment, the lateral wall of the inner housing adjoins the inflow chamber and the outflow chamber.

According to one embodiment, the first piston inlet opening is arranged in the region of an end wall of the piston, in particular a first end wall of the piston.

According to one embodiment, the second piston inlet opening is arranged in the region of a lateral wall of the piston.

According to one embodiment, the piston outlet opening is arranged in the region of an end wall of the piston, in particular in the region of a second end wall of the piston.

Irrespective of the geometrical configuration of the piston or of the inner housing, a "lateral wall" is understood to mean a wall which runs around the piston and/or the inner housing parallel or substantially parallel to a physical or imaginary longitudinal axis of the piston and/or of the inner housing.

Irrespective of the geometrical configuration of the piston or of the inner housing, an "end wall" is understood to mean a wall which is arranged perpendicularly or substantially perpendicularly to a physical or imaginary longitudinal axis of the piston and/or of the inner housing.

In particular, the inner housing and the piston each have two end walls (a first and a second end wall), and the respective lateral wall extends between these two end walls.

It is not only the free-flow cross-sectional area of the second piston inlet opening, in particular the magnitude thereof, that can be changed by moving the piston in the axial direction. Rather, moving the piston in the axial direction also makes it possible to change the distance, in particular between a first end wall of the piston and a first end wall of the inner housing, and thereby the distance between the first housing inlet opening and the first piston inlet opening.

The change in the free-flow cross-sectional area of the second piston inlet opening and thus the change in the volume flow of cooled process gas which flows into the piston interior results in a corresponding pressure drop, which in turn leads to different pressure levels in the inflow chamber and the outflow chamber. As the fluidically interconnected chambers and the flows prevailing therein attempt to compensate for this different pressure level that occurs, the volume flow of the hot process gas which can flow into the piston interior via the first housing inlet opening and the first piston inlet opening changes correspondingly. This also gives control over the volume flow of the hot process gas.

The hot process gas which emerges from the at least one hot gas line and can flow into the piston interior via the first housing inlet opening and the first piston inlet opening can also be referred to as uncooled process gas or substantially uncooled process gas. The (at least one) hot gas line can also be referred to as a bypass line. This should be understood to mean that the hot gas line in question is not cooled or is cooled only insignificantly, that is to say its cooling is bypassed. This can be due to the fact that the hot process gas in the hot gas line is not cooled by indirect cooling with the aid of a cooling medium, or that the hot gas line has a diameter so large that no cooling or only insignificant cooling takes place by indirect cooling with a cooling medium flowing around the hot gas line.

The interior of the inner housing is fluidically connected to the at least one hot gas line. In this arrangement, the interior of the inner housing can be connected to the hot gas line directly or, for example, via one or more transition pieces. The control device can also comprise a plurality of hot gas lines, for which the same configuration applies. That is, the interior of the inner housing is then fluidically connected to this plurality of hot gas lines, thus enabling the entire quantity of the hot process gas from these hot gas lines to flow into the interior of the inner housing.

The inflow chamber is fluidically connected to at least one cold gas line, but generally to a multiplicity of cold gas lines. The cold gas line or the multiplicity of cold gas lines thereby forms the main cooling surface of the device for providing the cooled process gas. In particular, a cooling medium flows around the cold gas line or the multiplicity of cold gas lines, said cooling medium cooling the process gas and thus providing cooled process gas. Accordingly, the cold gas line(s) carries/carry the cooled process gas.

"Temperature-controlled process gas" is understood to mean, in particular, the process gas which can be produced by mixing the hot process gas and the cooled process gas in the piston interior and, after flowing out of the piston interior into the interior of the inner housing and subsequently flowing out into the outlet chamber, can be discharged from the device, i.e. can flow out, via the outlet nozzle.

Since the device according to the invention advantageously allows the second piston inlet opening to be completely closed, making the free-flow cross-sectional area of the second piston inlet opening equal to zero, the "temperature-controlled process gas" for this extreme case can also be a process gas which has the same or substantially the same temperature as the hot process gas.

The device according to the invention furthermore advantageously makes it possible to completely close the first piston inlet opening, the control device being configured in such a way that the first piston inlet opening is simultaneously opened, and, according to one embodiment, completely opened. In this extreme case, the "temperature-controlled process gas" can be a process gas which has the same or substantially the same temperature as the cooled process gas.

One embodiment of the control device is characterized in that the first housing inlet opening of the inner housing is arranged within a first end wall of the inner housing, and the first piston inlet opening is arranged within a first end wall of the piston, wherein the openings are arranged in such a way relative to one another that the hot process gas cannot flow through the first housing inlet opening of the inner housing and the first piston inlet opening when the end walls are brought into surface contact.

This enables the control device to be operated in such a way that no hot process gas passes through the inner housing in the direction of the outflow chamber. According to one preferred embodiment, the second piston inlet opening is simultaneously completely open.

The first housing inlet opening and the first piston inlet opening can be arranged offset relative to one another in such a way that the hot process gas cannot flow through these openings when the end walls are brought into surface contact. In other words, these openings are arranged in such a way that they do not overlap when the end walls are brought into surface contact, with the result that no flow is possible through these openings.

The axial movement of the piston enables the second piston inlet opening to be completely closed, with the result that only hot process gas passes through the device. By means of the abovementioned embodiment, it is thus possible to implement the other extreme case, namely that exclusively hot process gas passes through the device.

The control device thus makes it possible to control the temperature of the process gas over the entire temperature range of the two process gas types, cooled and hot process gas.

According to one embodiment, the second housing inlet opening and the second piston inlet opening are therefore arranged in such a way, in particular the second housing inlet opening being arranged in the region of the lateral wall of the inner housing and the second piston inlet opening being arranged in the region of the lateral wall of the piston in such a way, that, when the first end wall of the inner housing and the first end wall of the piston are brought into surface contact, the free-flow cross-sectional area of the second piston inlet opening corresponds to the maximum opening area of the second piston inlet opening.

One preferred embodiment of the control device is characterized in that the first housing inlet opening of the inner housing and/or the first piston inlet opening are/is designed as (an) annular gap(s).

One preferred embodiment of the control device is characterized in that the first end wall of the piston has a seal element mechanically connected to this end wall.

It is thereby possible to reduce leakage flows on the hot gas line side to a minimum.

One embodiment of the control device is characterized in that the piston is mechanically connected to the actuating drive via a shaft.

In this context, one preferred embodiment of the control device is characterized in that the piston is mechanically connected to the actuating drive via a shaft, and the shaft has a mechanical stop element fixedly connected to it, wherein the stop element

- is arranged in the interior of the inner housing and outside the piston, or
- is arranged within the outflow chamber and outside the inner housing, and is arranged in such a way that complete closure of the opening, which is defined by the free-flow cross-sectional area of the second piston inlet opening, can be prevented.

The mechanical stop element is fixedly connected to the shaft, that is to say connected to the shaft in such a way that the position of the stop element cannot be changed during operation of the control device. According to one example, the stop element is connected non-positively to the shaft, for example is connected to the shaft by way of a screw connection or a clamping connection.

The stop element can be arranged in the interior of the inner housing and outside the piston. According to this embodiment, it is possible in one example for the stop element to strike against a wall of the inner housing, in particular against the inner side of the second end wall of the inner housing, during a corresponding stroke of the piston.

The stop element can be arranged within the outflow chamber and outside the inner housing. According to this embodiment, the stop element according to one example can strike against a wall of the outer housing, in particular against an inner side of a wall of the outer housing, during a corresponding stroke of the piston.

The stop element is arranged in such a way that complete closure of the opening which defines the free-flow cross-sectional area of the second piston inlet opening can be prevented or is prevented. In other words, the stop element is mechanically connected to the shaft in a fixed manner at a defined position, wherein the positioning of the stop element does not allow the second piston inlet opening to be closed, as a result of which cooled process gas from the inflow chamber would not be able to flow through it (any longer).

If the control device fails, the stop element prevents the connection between the inflow chamber and the piston interior from closing completely, as a result of which the only flow through the control device would be that of hot process gas from the hot gas line. Excessively high temperatures in the region of the outlet of the control device, in particular in the region of the outlet nozzle, are thereby prevented. Excessively high temperatures at the outlet of the device can damage devices arranged downstream of the control device.

One preferred embodiment of the control device is characterized in that the position of the mechanical stop element in the axial direction along the shaft can be changed, in particular can be changed in accordance with the prevailing operating conditions.

According to this embodiment, the mechanical stop element is, in particular, not connected to the shaft by a materially integral connection, such as, for example, a welded connection. Rather, the stop element is connected to the shaft by a releasable connection, for example by a non-positive connection, thus enabling the position of the stop element to be changed, for example during maintenance work on a relevant plant.

Thus, it may be expedient, for example, to increase the free-flow cross-sectional area defined by the second piston inlet opening in the event of stop contact of the stop element (in the event of failure of the control device) with progressive contamination or corrosion of the cold gas lines. As a result of such progressive contamination or corrosion, the process gas in question is cooled less, making it advantageous to correspondingly increase the volume flow of the cooled process gas. Increasing the volume flow through the cold gas lines improves the heat transfer from gas to water (coolant). This compensates for the insulating effect of a dirt layer, which is formed primarily on the outside of the cold gas lines, i.e. on the coolant side. Corresponding considerations must be entered into with regard to the hot gas line(s) which carries/carry the uncooled process gas.

One preferred embodiment of the control device is therefore characterized in that the position of the mechanical stop element in the axial direction along the shaft can be changed in accordance with the temperature of the cooled process gas and/or the temperature of the uncooled process gas.

For the above reasons, one preferred embodiment of the control device is advantageously characterized in that the position of the mechanical stop element in the axial direction along the shaft can be changed in accordance with the degree of contamination of the at least one cold gas line and/or the degree of contamination of the at least one hot gas line.

One preferred embodiment of the control device is characterized in that the piston can be rotated in the radial direction by means of an actuating drive, thus enabling the free-flow cross-sectional area of the second piston inlet opening to be changed by the rotation of the piston in the radial direction.

According to this embodiment, a further degree of freedom is introduced, relating to the changeability of the free-flow cross-sectional area defined by the second piston inlet opening.

As a result, the shaft can be rotated in the radial direction, for example, in a case when the stop element has reached its end position, that is to say the position of the mechanical stop. This enables the second piston inlet opening to be closed even when the stop has been reached, thereby making it possible to increase the temperature of the temperature-controlled process gas to the maximum temperature (corresponding to the temperature of the hot process gas) even at the mechanical stop. This is made possible independently of the operation of the actuating drive which controls the axial movement of the piston. As a result, it is possible to adjust the mechanical stop as a function of the contamination rate of the cold gas lines and hot gas line(s).

One preferred embodiment of the control device is characterized in that the piston can be moved in the axial direction by means of a first actuating drive, and the piston can be rotated in the radial direction by means of a second actuating drive.

As a result, the axial movement and the radial movement can be performed independently of one another. Thus, for example, the radial rotation of the piston by the second actuating drive is still possible even when the first actuating drive has failed and the piston is in the position of the mechanical stop.

One preferred embodiment of the control device is characterized in that the piston is in the form of a right hollow cylinder.

According to this embodiment, the piston is in the form of a right hollow cylinder, or is in the form of a substantially right hollow cylinder, or is substantially in the form of a right hollow cylinder.

To simplify design and maintenance, the piston is preferably in the form of a right hollow cylinder. This geometry makes it possible to completely close the opening(s) to the at least one hot gas line with simultaneously low leakage rates with respect to the space between the piston and the inner side of the inner housing.

As an alternative thereto, the piston is in the form of a hollow truncated cone, wherein the diameter of the truncated cone decreases along the direction of flow of the gases flowing through the piston interior.

As a result, the surface of the piston can be sealed efficiently against the inner side of the inner housing, particularly in the case of a large stroke (distance between the end walls of the inner housing and the piston), as a result of which lower leakage rates can be achieved than in the case of the design as a right hollow cylinder.

At least one of the abovementioned objects is furthermore at least partially achieved by a heat exchanger, having a control device according to one of the abovementioned embodiments, wherein the heat exchanger has a multiplicity of cold gas lines, which are arranged in parallel to one another and configured as a tube bundle and are fluidically connected to the inflow chamber, and wherein the heat exchanger has a centrally arranged hot gas line, which has a larger diameter than the cold gas lines.

The heat exchanger comprises the control device according to the invention, or the control device forms part of the heat exchanger. The heat exchanger is preferably a shell-and-tube heat exchanger. The heat exchanger has a centrally arranged hot gas line, but according to one embodiment can also comprise a plurality of centrally arranged hot gas lines. The hot gas line or hot gas lines and the cold gas lines can be arranged coaxially. The hot gas line can also be referred to as a bypass line. This should be understood to mean that the cooling of the process gas in the hot gas line is either completely or substantially completely bypassed.

One preferred embodiment of the heat exchanger is characterized in that the cold gas lines each have an inlet end and an outlet end, and the hot gas line has an inlet end and an outlet end, wherein the outlet ends of the cold gas lines merge into the inflow chamber and the outlet end of the hot gas line merges into the inner housing, and wherein the inlet ends of the cold gas lines and the inlet end of the hot gas line merge into a process gas inflow chamber, wherein the process gas inflow chamber has a process gas inlet nozzle.

Via the process gas inflow chamber, hot process gas can flow into both the hot gas line and the cold gas lines. Some of the hot process gas is then cooled in the cold gas lines, and some flows through the hot gas line and is not cooled or substantially not cooled as it does so.

At least one of the abovementioned objects is furthermore at least partially achieved by using the control device according to one of the abovementioned embodiments of the control device or according to one of the abovementioned embodiments of the heat exchanger to cool synthesis gas from a steam reformer or an autothermal reformer.

BRIEF DESCRIPTION OF THE DRAWINGS

The invention is more particularly elucidated hereinbelow by exemplary embodiments. In the following detailed description, reference is made to the attached drawings, which show specific embodiments of the invention by way of illustration. In this connection, direction-specific terminology such as "top", "bottom", "front", "back", etc., is used with reference to the orientation of the described figure. Since components of embodiments may be positioned in a multiplicity of orientations, the direction-specific terminology is used for illustration and is in no way limiting. A person skilled in the art will appreciate that other embodiments may be used and structural or logical changes may be undertaken without departing from the scope of protection of the invention. The following detailed description is therefore not to be understood in a limiting sense, and the scope of protection of the embodiments is defined by the accompanying claims. Unless otherwise stated, the drawings are not true to scale.

In the figures.

DETAILED DESCRIPTION OF PREFERRED EMBODIMENTS

Figure 1:
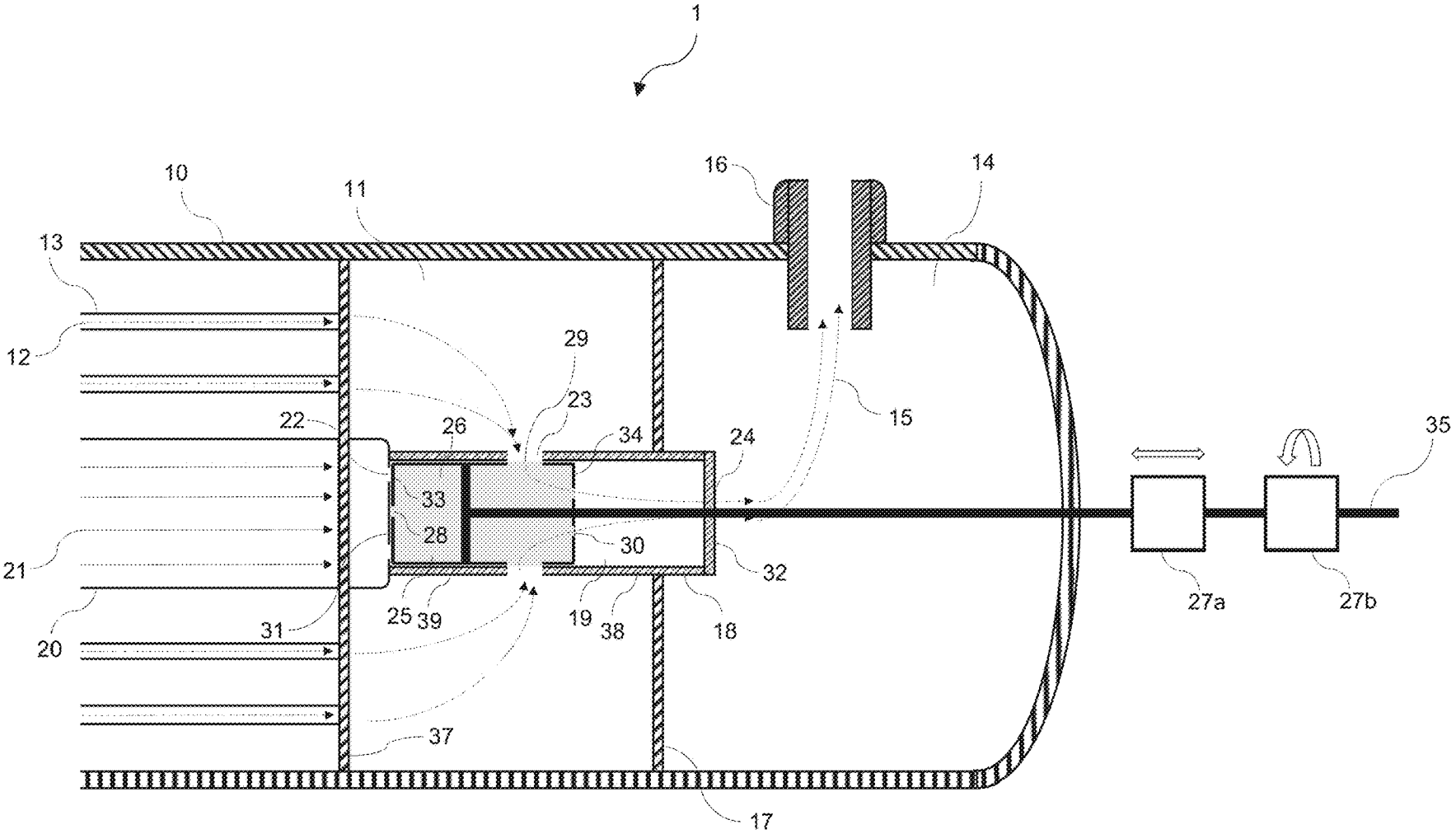
FIG. 1 shows a lateral cross-sectional view of a control device according to the invention with the first piston inlet opening closed and the second piston inlet opening completely open.
Figure 2:
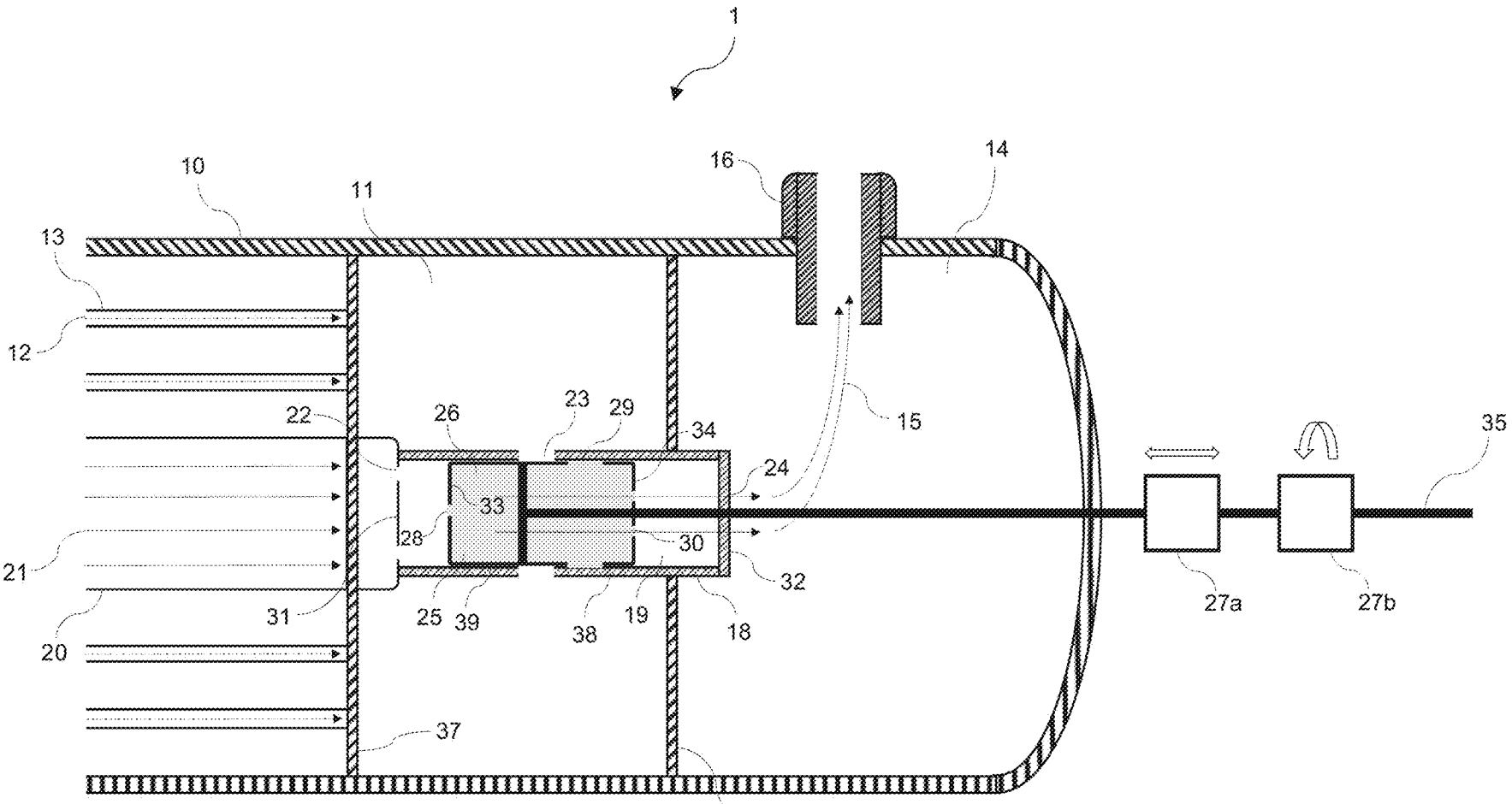
FIG. 2 shows a lateral cross-sectional view of a control device according to the invention with the first piston inlet opening open and the second piston inlet opening completely closed.
Figure 3:
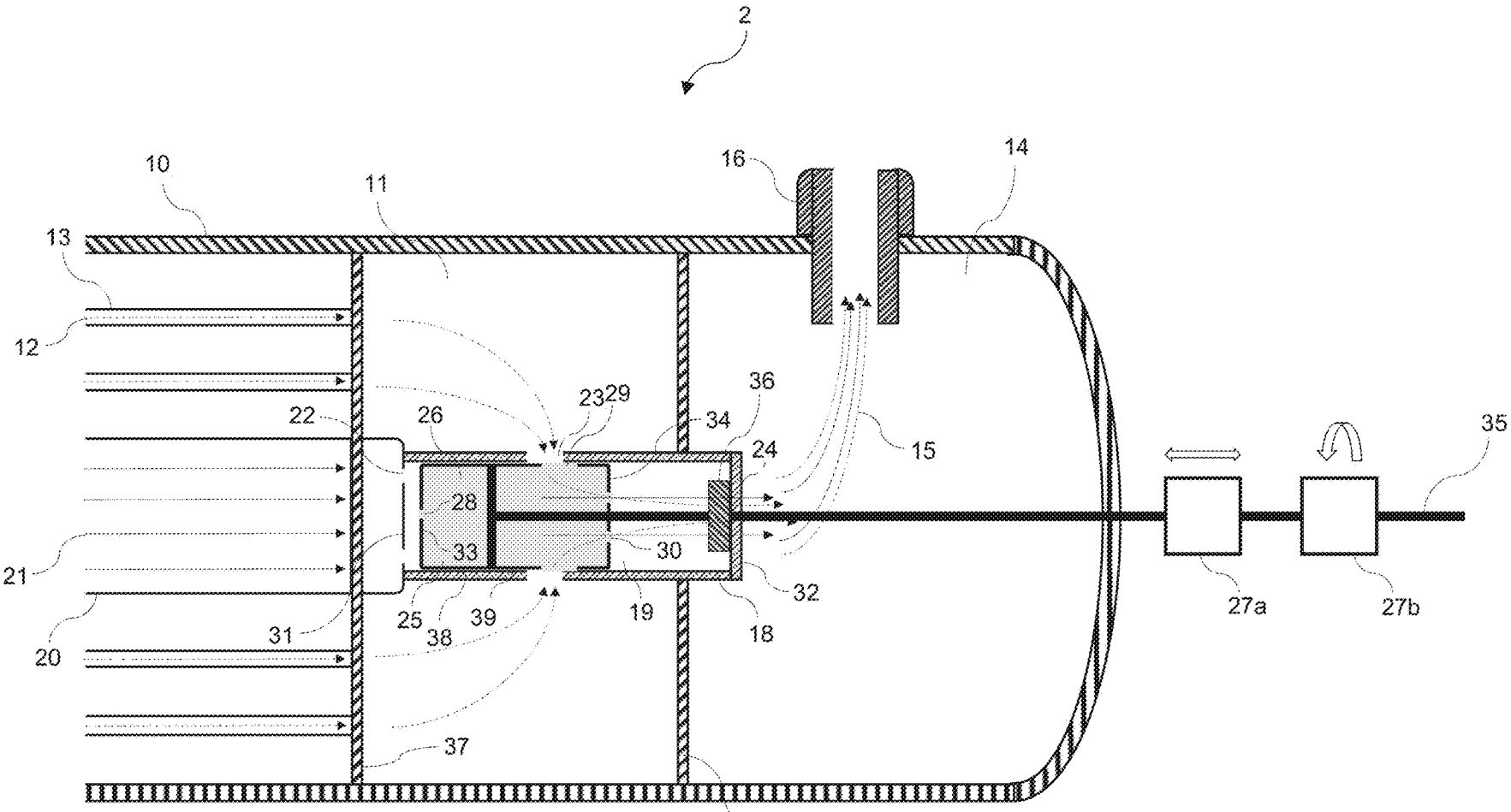
FIG. 3 shows a lateral cross-sectional view of a control device according to the invention having a mechanical stop element, with the first piston inlet opening open and the second piston inlet opening partially open.

In FIGS. 1 to 3, identical elements are each provided with identical reference numerals.

FIG. 1 shows a simplified illustration of a lateral cross-sectional view of the control device according to the invention with the first piston inlet opening closed and the second piston inlet opening completely open.

The control device 1 has an outer housing 10, which comprises an inflow chamber 11 and an outflow chamber 14. The inflow chamber 11 and the outflow chamber 14 are spatially separated from one another by a mechanical separating element 17. Arranged within the outer housing 10 is an inner housing 18, which extends within the inflow chamber 11, through the mechanical separating element 17, and within the outflow chamber 14. The inner housing is fluidically connected via a plurality of openings 22, 23 and 24 (opening 24 not shown) to both a hot gas line 20, the inflow chamber 11 and the outflow chamber 14. The inner housing 18 has an interior 19. The openings 22, 23 and 24 are located within the wall of the inner housing and thus establish fluidic connections between the interior 19 of the inner housing 18 and the hot gas line 20, the inflow chamber 11 and the outflow chamber 14. In addition, the control device 1 has a multiplicity of cold gas lines 13, which are fluidically connected to the inflow chamber. While cooled process gas 12 flows through the cold gas lines 13, hot process gas 21 flows through the hot gas line 20. Owing to the large diameter of the hot gas line 20 in comparison with the small diameter of the cold gas lines 13, the hot process gas 21 is cooled only insignificantly in the hot gas line 20. The outlet ends of the cold gas lines 13 (not shown) and the outlet end of the hot gas line 20 (not shown) are fixed within the holes (not shown) of a perforated plate 37, which extends over the cross-sectional area of the outer housing. A cooling medium flows around the cold gas lines 13 and the hot gas line 20, as a result of which cooling of the process gas flowing into the cold gas lines 13 is achieved.

The control device 1 can also be regarded as part of a shell-and-tube heat exchanger with a centrally arranged bypass tube, in this case the hot gas line 20. As is known to a person skilled in the art, a heat exchanger of this kind has a corresponding inlet nozzle and an outlet nozzle for cooling medium. The nozzles are not shown in the figures. The cooling medium is, in particular, cooling water, which is discharged from the heat exchanger as steam owing to the cooling of the hot process gas and can subsequently be used as heating steam or process steam.

The hot gas line 20 extends through the perforated plate 37 into the inflow chamber 11 and is thereby mechanically fixedly connected to the inner housing 18. The part of the hot gas line 20 which extends through the inflow chamber 14 can also be regarded not as part of the hot gas line 20 but as a connecting piece or transition piece between the hot gas line 20 and the inner housing 18. The inner housing 18 has a first end wall 31, in which a first housing inlet opening 22 designed as an annular gap is arranged. Through the first housing inlet opening 22, the hot process gas 21 can flow into the interior 19 of the inner housing 18 when the opening 22 is open and thus allows a throughflow. The inner housing 18 also has a housing outlet opening 24 (opening not shown), which is arranged within a second end wall 32 of the inner housing. Via the housing outlet opening 24, a temperature-controlled process gas 15 can flow out of the interior 19 of the inner housing 18 into the outflow chamber 14. The temperature-controlled process gas 15 can then be discharged from the control device 1 via an outlet nozzle 16 leading out of the outflow chamber 14. The inner housing 18 furthermore has a second housing inlet opening 23, which is arranged within the lateral wall 38 of the inner housing. As shown in the figure, there may be a plurality of such openings 23.

Arranged in the interior 19 of the inner housing 18 is a piston 25, which is designed as a cylindrical hollow body and is connected via a shaft 35 to an actuating drive 27*a* and a further actuating drive 27*b*. The piston 25 has a piston interior 26. The shaft is mechanically fixedly connected to the piston, that is to say the piston 25 and the shaft 35 form a mechanical unit which can be moved by means of the actuating drives 27*a* and 27*b*.

The piston 25 can be moved in the axial direction, that is to say along its longitudinal axis, which is formed in part by the shaft 35, by means of the actuating drive 27*a*. This type of movement is indicated by the bidirectional arrow on the actuating drive 27*a*.

The piston 25, which is designed as a hollow body, has a plurality of openings 28, 29 and 30, through which flow through the piston can take place. A first piston inlet opening 28 is arranged within a first end wall 33 of the piston 25. After passing through the first housing inlet opening 22, hot process gas 21 can flow through the first piston inlet opening 28 into the piston interior 26 when the piston 25 is in a corresponding position. A second piston inlet opening 29 is arranged within a lateral wall 39 of the piston. As shown in the figure, there may be a plurality of such openings 29. After passing through the second housing inlet opening 23, cooled process gas 12 can flow through the second piston inlet opening 29 into the piston interior 25 when the piston is in a corresponding position.

The free-flow cross-sectional area of the second piston inlet opening can be changed by the movement of the piston 25 in the axial direction by the actuating drive 27*a*. That is to say that the second housing inlet opening 23 and the second piston inlet opening 29 are arranged in such a way relative to one another that the size of the second piston inlet opening and thus the magnitude of the free-flow cross-sectional area of this opening can be changed.

In the example according to FIG. 1, the piston 25 is in a position in which the second piston inlet opening 29 is open to a maximum extent, that is to say the entire opening or the entire cross-sectional area of this opening is available for cooled process gas 12 to flow through. According to the example of FIG. 1, the second housing inlet opening 23 and the second piston inlet opening 29 lie congruently one above the other. The flow-through areas defined by the second housing inlet opening 23 and the second piston inlet opening 29 do not have to be of the same size but can also be of different sizes. The only decisive factor is that the two openings are arranged in such a way relative to one another that the free-flow cross-sectional area of the second piston inlet opening 29 can be changed.

In the example according to FIG. 1, the piston 25 is furthermore in a position in which access to the hot gas line 20 is closed. This results from the fact that the first housing inlet opening 22 and the first piston inlet opening 28 are arranged in such a way relative to one another that the hot process gas 21 cannot flow through them when the first end wall 31 of the inner housing 18 and the first end wall 33 of the piston 35 are brought into surface contact. This is achieved by virtue of the fact that the corresponding openings 22 and 28 are arranged offset from one another and do not overlap when there is corresponding surface contact.

FIG. 2 shows a lateral cross-sectional view of a control device according to the invention with the first piston inlet opening open and the second piston inlet opening completely closed.

In the example according to FIG. 2, the control device 1 is shown with a position of the piston 25 in which access to the second piston inlet opening 29 is completely closed. At the same time, access to the hot gas line 20 is thereby completely opened, as a result of which a maximum flow of hot process gas 21 is made possible. The flow of cooled process gas 12 is thus zero or limited to negligible leakage flows. If the piston 25 is moved continuously to the left by means of the actuating drive 27*a*, the free-flow cross-sectional area of the second piston inlet opening 29 is continuously enlarged and, as a result, the flow of cooled process gas 12 is likewise continuously increased. At the same time, the pressure drop between the inflow chamber 11 and the outflow chamber 14 likewise changes, as a result of which the quantity of hot process gas 21 which can flow into the piston 25 also changes, that is to say the flow of hot process gas 21 continuously decreases.

In the piston interior, mixing of the hot process gas 21 and the cooled process gas 12 takes place, whereby the temperature-controlled process gas 15 is obtained. This flows via the piston outlet opening 30 and the housing outlet opening 24 into the outflow chamber. As already mentioned above, a "temperature-controlled process gas" 15 is also referred to when access to the hot gas line 20 or to the inflow chamber 11 is closed in accordance with the position of the piston 25.

The control device 1 furthermore has a second actuating drive 27*b*, by means of which the piston can be moved in the radial direction, that is to say can be rotated about its longitudinal axis. This second actuating drive 27*b* thus represents a further degree of freedom with respect to the changeability of the free-flow cross-sectional area of the second piston inlet opening 29. If the second piston inlet opening is a circular opening, for example, this opening 29 can be closed or at least further reduced in size by the radial movement even when openings 23 and 29 lie one on top of the other. The radial movement of the piston 25 by way of the shaft 35 by means of the second actuating drive 27*b* is indicated by the semicircular arrow.

FIG. 3 shows a lateral cross-sectional view of a control device according to the invention having a mechanical stop element, with the first piston inlet opening open and the second piston inlet opening partially open.

FIG. 3 shows an example of a control device 2 having an integrated mechanical stop element 36. The stop element 36 is arranged within the inner housing 18, i.e. in the interior 19 of the inner housing 18, and is fixedly connected to the shaft 35. This fixed connection can be achieved, for example, by a non-positive connection such as a screw connection. It is crucial that the connection is a releasable connection. The stop element 36 is thus preferably not connected to the shaft 35 by way of a materially integral connection, such as a welded connection. A releasable connection makes it possible to change the position of the stop element 36 in accordance with certain prevailing operating parameters, such as the degree of contamination of the hot gas line 20 and the cold gas lines 13. The stop element 36 ensures that the shaft 35, together with the piston 25, cannot be moved to such an extent that the second piston inlet opening 29 is closed, even in the event of a technical failure of the control device 2, in particular of the actuating drive 27*a*. This prevents only hot process gas 21 from leaving the control device 2 via the outlet nozzle 16. Depending on the respective plant, this may be desirable since excessively hot process gases may damage plant components arranged downstream. If complete closure of the second piston inlet opening 29 is nevertheless desirable in such a case, this is possible by way of the second actuating drive 27*b*.

LIST OF REFERENCE SYMBOLS

1, 2 Control device
10 Outer housing
11 Inflow chamber
12 Cooled process gas
13 Cold gas line
14 Outflow chamber
15 Temperature-controlled process gas
16 Outlet nozzle
17 Mechanical separating element
18 Inner housing
19 Interior of the inner housing
20 Hot gas line
21 Uncooled process gas
22 First housing inlet opening
23 Second housing inlet opening
24 Housing outlet opening
25 Piston
26 Piston interior
27*a* First actuating drive
27*b* Second actuating drive
28 First piston inlet opening
29 Second piston inlet opening
30 Piston outlet opening
31 First end wall, inner housing
32 Second end wall, inner housing
33 First end wall, piston
34 Second end wall, piston
35 Shaft
36 Stop element
37 Perforated plate
38 Lateral wall, inner housing
39 Lateral wall, piston It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A control device for controlling the temperature of a process gas, having an outer housing;

an inflow chamber, arranged within the outer housing, for a cooled process gas, wherein the inflow chamber is fluidically connected to at least one cold gas line for carrying the cooled process gas;

an outflow chamber, arranged within the outer housing, for temperature-controlled process gas;

an outlet nozzle, which extends through the outer housing in the region of the outflow chamber, wherein the outlet nozzle is configured to discharge the temperature-controlled process gas from the outer housing;

a mechanical separating element, which spatially separates the inflow chamber and the outflow chamber from one another;

an inner housing having an interior, wherein the interior is fluidically connected to at least one hot gas line for carrying hot process gas, wherein the inner housing extends within the inflow chamber and through the mechanical separating element into the outflow chamber, wherein the inner housing comprises a first housing inlet opening arranged in such a way that the hot process gas may flow into the interior of the inner housing, and wherein the inner housing comprises a second housing inlet opening, arranged in such a way that cooled process gas may flow into the interior of the inner housing, and wherein the inner housing comprises a housing outlet opening arranged in such a way that temperature-controlled process gas may flow out of the interior of the inner housing into the outflow chamber;

a piston, through which flow may take place, designed as a hollow body and which has a piston interior, wherein the piston is movable in the axial direction within the inner housing by means of an actuating drive, wherein the piston comprises a first piston inlet opening arranged such that hot process gas may flow into the piston interior, and wherein the piston comprises a second piston inlet opening arranged such that cooled process gas may flow into the piston interior, and wherein the piston comprises a piston outlet opening arranged such that temperature-controlled process gas may flow out of the piston interior into the interior of the inner housing, wherein the second housing inlet opening of the inner housing and the second piston inlet opening are arranged relative to one another thereby allowing a free-flow cross-sectional area of the second piston inlet opening may be changed by the movement of the piston in the axial direction, thereby allowing control of a quantity of cooled process gas which may flow into the piston interior via the second housing inlet opening of the inner housing and via the second piston inlet opening.

2. The control device according to claim 1, wherein the first housing inlet opening of the inner housing is arranged within a first end wall of the inner housing, and the first piston inlet opening is arranged within a first end wall of the piston, wherein the openings are arranged in such a way relative to one another that the hot process gas may not flow through the first housing inlet opening of the inner housing and the first piston inlet opening when the end walls are brought into surface contact.

3. The control device according to claim 2, wherein the first housing inlet opening of the inner housing and/or the first piston inlet opening are/is designed as (an) annular gap(s).

4. The control device according to claim 2, wherein the first end wall of the piston has a seal element mechanically connected to the first end wall.

5. The control device according to claim 1, wherein the piston is mechanically connected to the actuating drive via a shaft, and the shaft has a mechanical stop element fixedly connected to it, wherein the stop element is arranged in the interior of the inner housing and outside the piston, or is arranged within the outflow chamber and outside the inner housing, and is arranged in such a way that complete closure of the opening, defined by the free-flow cross-sectional area of the second piston inlet opening, may be prevented.

6. The control device according to claim 5, wherein the position of the mechanical stop element in the axial direction along the shaft may be changed.

7. The control device according to claim 6, wherein the position of the mechanical stop element in the axial direction along the shaft may be changed in accordance with the temperature of the cooled process gas and/or the temperature of the uncooled process gas.

8. The control device according to claim 6, wherein the position of the mechanical stop element in the axial direction along the shaft may be changed in accordance with the degree of contamination of the at least one cold gas line and/or the degree of contamination of the at least one hot gas line.

9. The control device according to claim 1, wherein the piston may be rotated in the radial direction by means of an actuating drive, thus enabling the free-flow cross-sectional area of the second piston inlet opening to be changed by the rotation of the piston in the radial direction.

10. The control device according to claim 9, wherein the piston may be moved in the axial direction by means of a first actuating drive, and the piston may be rotated in the radial direction by means of a second actuating drive.

11. The control device according to claim 1, wherein the piston is in the form of a right hollow cylinder.

12. The control device according to claim 1, wherein the piston is in the form of a hollow truncated cone, wherein the diameter of the truncated cone decreases along the direction of flow of the gases flowing through the piston interior.

13. A heat exchanger, having a control device according to claim 1, wherein the heat exchanger has a multiplicity of cold gas lines arranged in parallel to one another and configured as a tube bundle and are fluidically connected to the inflow chamber, and wherein the heat exchanger has a centrally arranged hot gas line, which has a larger diameter than the cold gas lines.

14. The heat exchanger according to claim 13, wherein the cold gas lines each have an inlet end and an outlet end, and the hot gas line has an inlet end and an outlet end, wherein the outlet ends of the cold gas lines merge into the inflow chamber and the outlet end of the hot gas line merges into the inner housing, and wherein the inlet ends of the cold gas lines and the inlet end of the hot gas line merge into a process gas inflow chamber, wherein the process gas inflow chamber has a process gas inlet nozzle.

* * * * *